US010547142B1

(12) United States Patent
Henry et al.

(10) Patent No.: US 10,547,142 B1
(45) Date of Patent: Jan. 28, 2020

(54) LATCH ASSEMBLY FOR A PLUG CONNECTOR

(71) Applicant: TE CONNECTIVITY CORPORATION, Berwyn, PA (US)

(72) Inventors: Randall Robert Henry, Lebanon, PA (US); Michael John Phillips, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/352,989

(22) Filed: Mar. 14, 2019

(51) Int. Cl.
*H01R 13/627* (2006.01)
*H01R 12/79* (2011.01)

(52) U.S. Cl.
CPC ..... *H01R 13/6275* (2013.01); *H01R 12/79* (2013.01)

(58) Field of Classification Search
CPC ..... H01R 13/6275
USPC ..... 439/352
See application file for complete search history.

(56) References Cited

U.S. PATENT DOCUMENTS 4,630,876 A * 12/1986 Grunberg ..... H01R 24/84 439/293
6,071,141 A * 6/2000 Semmeling ..... H01R 13/6275 439/353
7,114,980 B1 * 10/2006 Wu ..... H01R 13/6275 439/352
7,163,413 B2 * 1/2007 Murayama ..... H01R 13/6272 439/258
7,651,361 B2 * 1/2010 Henry ..... H01R 13/6272 439/352
8,231,400 B2 7/2012 Phillips et al.
8,562,373 B2 * 10/2013 Wu ..... H01R 13/6335 439/352
8,747,141 B2 * 6/2014 Crain ..... H01R 13/6272 439/258
8,944,700 B2 2/2015 Shimoyasu et al.
9,130,308 B2 * 9/2015 Wang ..... H01R 13/6275
9,287,660 B2 * 3/2016 Henry ..... H01R 13/6275
9,419,367 B2 * 8/2016 Henry ..... H01R 9/034
9,496,645 B2 * 11/2016 Reed ..... H01R 13/6275
9,564,711 B2 * 2/2017 Tanaka ..... H01R 13/6272
9,728,871 B1 8/2017 Gutgold et al.
9,761,998 B2 * 9/2017 De Dios Martin ..... H01R 13/6272
10,168,490 B2 * 1/2019 Nonen ..... H01R 13/6335
10,230,196 B2 * 3/2019 Phillips ..... H01R 13/6275
10,367,299 B2 * 7/2019 Yao ..... H01R 13/6272
2018/0233855 A1 8/2018 Philiips et al.

* cited by examiner

FOREIGN PATENT DOCUMENTS

JP 2010211943 A 9/2010

*Primary Examiner* — Neil Abrams

(57) ABSTRACT

A plug connector includes a housing having a latch pocket holding a latch including a main body and a latch beam. The latch beam includes a latch hook received in a latch opening of a mating connector. An actuator is operably coupled to the latch to move the latch to a released position. The actuator includes a push button and a pull tab separate from the push button and movable in a rearward pulling direction relative to the push button. The latch hook is rotated from a latched position to the released position when the push button is actuated and when the pull tab is pulled in the rearward pulling direction without loading the latch against the mating connector.

20 Claims, 7 Drawing Sheets

LATCH ASSEMBLY FOR A PLUG CONNECTOR

BACKGROUND OF THE INVENTION

The subject matter herein relates generally to latches for plug connectors.

Connector systems including mating connectors configured to be mated for data and/or power transmission through the connector system. For example, the connector systems typically include complementary plug connectors and receptacle connectors configured to be mated to and unmated from each other. The connectors typically include latching features to secure mating of the plug connector with the receptacle connector. For example, the plug connector may include a deflectable latch having a latch hook configured to be received in a latch opening of the receptacle connector. However, known latches are not without disadvantages. For instance, some known latch designs have low connector to plug retention strength. The latches are subject to failure or breaking due to excessive force applied to the latch. The latches may become inadvertently unlatched, such as when the cable of the receptacle connector is pulled rearward, overcoming the retention force of the latch. Some known latches utilize a return spring to provide a return force to return the latch to a latched position and resist unintentional de-latching. However, with some known connectors, the return force may be high, leading to difficulties by users in overcoming the spring force to release the latch. Additionally, with latches that utilize a pull tab to actuate the latch, pulling rearward on the latch tends to pull the hook rearward against the corresponding latching component, causing the latch to bind against the latching component and thus increasing the de-latching force needed to move the latch to the released position.

A need remains for a cost effective and reliable latching system for a plug connector.

BRIEF DESCRIPTION OF THE INVENTION

In one embodiment, a plug connector is provided including a housing having a front and a rear. The housing has a first end and a second end opposite the first end that extends between the front and the rear. The housing has a first side and a second side opposite the first side that extends between the front and the rear. The housing has a mating end at the front for mating with a mating connector. The housing has a latch pocket at the first end. Plug contacts are held by the housing. The plug contacts are provided proximate to the mating end for mating with the mating connector. A latch is received in the latch pocket. The latch has a main body and a latch beam that extends from the main body. The latch beam includes a latch hook that is configured to be received in a latch opening of the mating connector to secure the plug connector to the mating connector. An actuator is operably coupled to the latch to move the latch to a released position. The actuator includes a push button and a pull tab. The push button is accessible at the first end and engages the main body of the latch for actuation of the latch. The pull tab extends from the rear of the housing and is pulled in a rearward pulling direction to actuate the latch. The pull tab is separate from the push button and is movable in the rearward pulling direction relative to the push button. The latch hook is rotated from a latched position to the released position when the push button is actuated by pressing inward toward the main body. The latch hook is rotated from the latched position to the released position when the pull tab is pulled in the rearward pulling direction without loading the latch against the mating connector.

Optionally, the latch hook may rotate away from the latch opening when the pull tab is initially pulled rearward. The latch hook may include a rear facing catch surface. The catch surface may be forward rotated away from the latch opening when the pull tab is initially pulled rearward. Rearward pulling motion of the pull tab may not be transferred from the latch to the housing until the latch is rotated to the released position. The latch beam may include an anchor point. The latch may be pivoted about the anchor point. The anchor point may be generally aligned with the latch hook. The anchor point may be coplanar with the latch hook in a plane parallel to the rearward pulling direction. The latch beam may include a return spring that may engage the housing. The return spring may operate to return the latch from the released position to the latched position. The return spring may act on the latch beam at a location between the main body and the latch hook.

Optionally, the pull tab may be slidably coupled to the push button. The pull tab may include an embossment engaging the push button to depress the push button as the pull tab is moved in the rearward pulling direction to actuate the latch. The push button may include an angled drive surface. The embossment may ride on the drive surface to actuate the push button as the pull tab is moved in the rearward pulling direction to actuate the latch. The latch beam may be a first latch beam. The latch may further include a second latch beam that may extend from the main body. The second latch beam may include a second latch hook that may be configured to be received in a corresponding latch opening of the mating connector to secure the plug connector to the mating connector.

In a further embodiment, a plug connector is provided. The plug connector includes a housing having a front and a rear. The housing has a first end and a second end opposite the first end that extends between the front and the rear. The housing has a first side and a second side opposite the first side that extends between the front and the rear. The housing has a mating end at the front for mating with a mating connector. The housing has a latch pocket at the first end. Plug contacts are held by the housing. The plug contacts are provided proximate to the mating end for mating with the mating connector. A latch is received in the latch pocket. The latch is movable within the housing between a latched position and a released position. The latch has a main body and a latch beam that extends from the main body. The latch beam includes a latch arm. The latch beam includes a latch hook that extends from the latch arm. The latch hook is configured to be received in a latch opening of the mating connector to secure the plug connector to the mating connector. The latch beam includes an anchor point secured to the housing. The latch beam is pivotably coupled to the housing at the anchor point. The latch beam includes a pull arm that extends from the latch arm. The pull arm is offset from the anchor point. An actuator is operably coupled to the latch to move the latch from the latched position to the released position. The actuator includes a push button and a pull tab. The push button engages the main body of the latch for actuation of the latch. The pull tab is coupled to the latch arm. The pull tab extends from the rear of the housing and is pulled in a rearward pulling direction to actuate the latch.

In another embodiment, a plug connector is provided. The plug connector includes a housing that has a front and a rear. The housing has a first end and a second end opposite the first end that extends between the front and the rear. The housing has a first side and a second side opposite the first side that extends between the front and the rear. The housing has a mating end at the front for mating with a mating connector. The housing has a latch pocket at the first end. Plug contacts are held by the housing. The plug contacts are provided proximate to the mating end for mating with the mating connector. A latch is received in the latch pocket. The latch is movable within the housing between a latched position and a released position. The latch has a main body and a latch beam that extends from the main body. The latch beam includes a latch arm. The latch beam includes a latch hook that extends from the latch arm. The latch hook is configured to be received in a latch opening of the mating connector to secure the plug connector to the mating connector. The latch beam includes an anchor point secured to the housing. The latch beam is pivotably coupled to the housing at the anchor point. The latch beam includes a pull arm extending from the latch arm. The pull arm is offset from the anchor point. The latch beam includes a return spring that extends from the latch arm and engages the housing. The return spring operates to return the latch from the released position to the latched position. An actuator is operably coupled to the latch to move the latch from the latched position to the released position. The actuator includes a push button and a pull tab. The push button engages the main body of the latch for actuation of the latch. The pull tab is coupled to the latch arm. The pull tab extends from the rear of the housing and is pulled in a rearward pulling direction to actuate the latch.

DETAILED DESCRIPTION OF THE INVENTION

Figure 1:
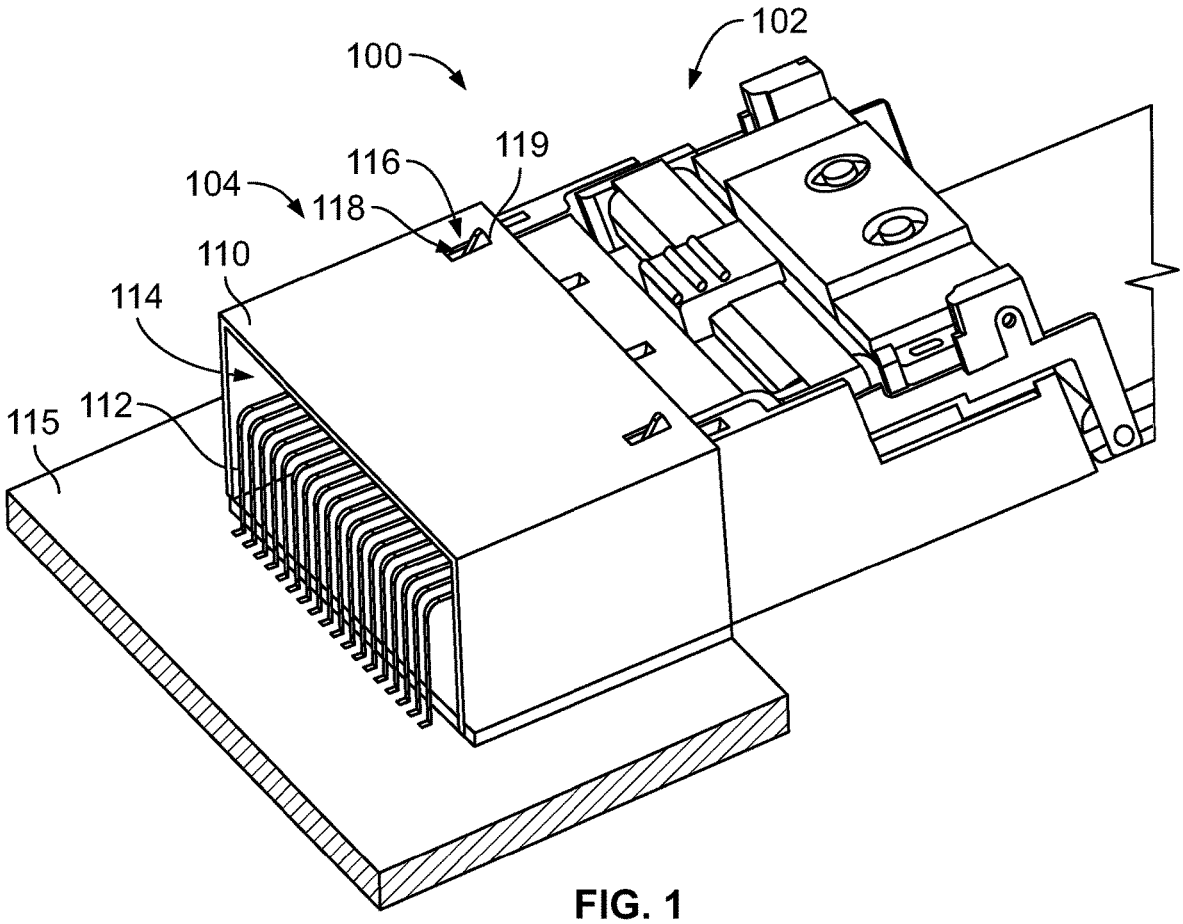
FIG. 1 illustrates a connector system having a plug connector formed in accordance with an exemplary embodiment.

FIG. 1 illustrates a connector system 100 formed in accordance with an exemplary embodiment. The connector system 100 includes a plug connector 102 and a receptacle connector 104. The plug connector 102 is configured to be mated with the receptacle connector 104 at a separable mating interface. The receptacle connector 104 defines a mating connector for the plug connector 102.

The receptacle connector 104 includes a housing 110 holding receptacle contacts 112 configured to be mated with the plug connector 102. The receptacle contacts 112 may be arranged within a cavity 114 that receives a portion of the plug connector 102. The housing 110 and the receptacle contacts 112 may be terminated to a circuit board 115. For example, the receptacle contacts 112 may be press fit in vias in the circuit board 115 or soldered to surface pads of the circuit board 115. In other various embodiments, the receptacle connector 104 may be a cable connector terminated to an end of a cable with the receptacle contacts 112 terminated to wires of the cable. In various embodiments, the receptacle connector 104 may have a card slot (not shown) at a front of the housing 110 configured to receive a circuit card of the plug connector 102. The receptacle contacts 112 may include spring beam contacts configured to be mated with the circuit card. However, the receptacle contacts 112 may be other types of contacts in alternative embodiments, such as contact pads. In other various embodiments, the housing 110 of the receptacle connector 104 may hold a circuit card configured to be mated with the plug connector 102. For example, the receptacle contacts 112 may be contact pads on the circuit card.

The receptacle connector 104 includes latching features 116 for latchably securing the plug connector 102 to the receptacle connector 104. In the illustrated embodiment, the latching features 116 include latch openings 118 in the housing 110 configured to receive complementary latching features of the plug connector 102. The latch openings 118 are defined by walls surrounding the latch openings 118. In the illustrated embodiment, the latch openings 118 are provided in the housing 110, such as in the top wall of the housing 110. For example, the top wall of the housing 110 may be a metal sheet or plate with the latch opening 118 stamped or cut into the top wall. The latch openings 118 may be provided at other locations in alternative embodiments. In an exemplary embodiment, a portion of the plug connector 102 is loaded into the cavity of the housing 110 to interface with the latching features 116 from inside the housing 110.

Figure 2:
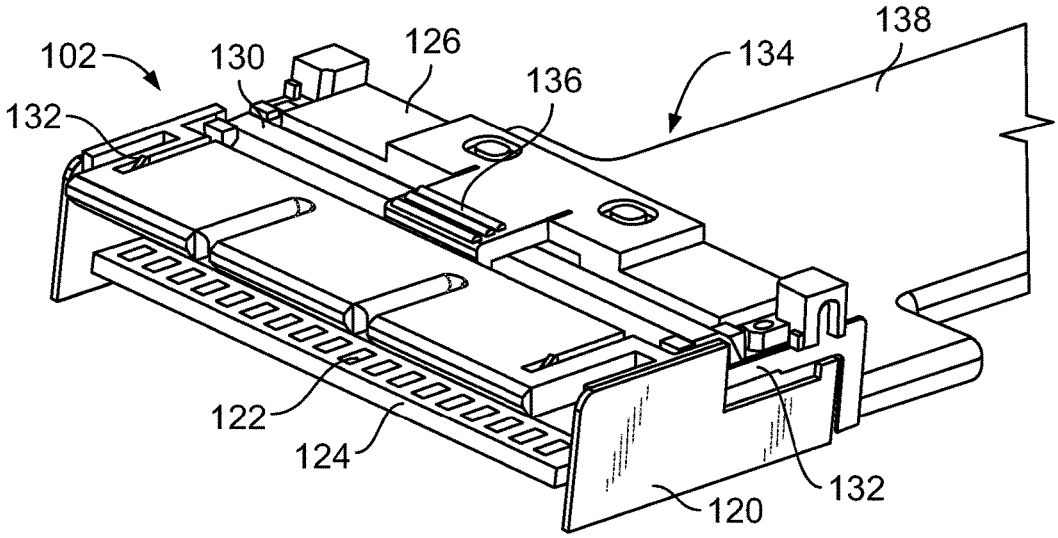
FIG. 2 is a front perspective view of the plug connector in accordance with an exemplary embodiment.

FIG. 2 is a front perspective view of the plug connector 102 in accordance with an exemplary embodiment. The plug connector 102 includes a housing 120 holding plug contacts 122 configured to be mated with corresponding receptacle contacts 112 of the receptacle connector 104 (both shown in FIG. 1). In the illustrated embodiment, the receptacle connector 104 includes a circuit card 124 configured to be plugged into the card slot of the receptacle connector 104. The plug contacts 122 are contact pads at a card edge of the circuit card 124. However, the plug contacts 122 may be other types of contacts in alternative embodiments, such as spring beams. In other various embodiments, the housing 120 of the plug connector 102 may include a card slot configured to receive a circuit card of the receptacle connector 104 and the housing 120 may hold discrete plug contacts 122, such as spring beam contacts, for mating to the circuit card or other types of mating contacts.

The plug connector 102 includes a cover 126 coupled to the housing 120. The cover 126 closes the housing 120, such as at the top of the housing 120. The cover 126 may be used to secure the circuit card 124 in the housing 120. The cover 126 may be used to secure a latch 130 in the housing 120.

In an exemplary embodiment, the plug connector 102 may include cables (not shown) extending from the rear of the housing 120. The cables are electrically connected to corresponding plug contacts 122. For example, the cables may be terminated to the circuit card 124, such as by soldering.

The plug connector 102 includes the latch 130 for latchably securing the plug connector 102 to the receptacle connector 104. The latch 130 is coupled to the housing 120. The latch 130 may be secured in the housing 120 using the cover 126. For example, the cover 126 may cover a portion of the latch 130. In the illustrated embodiment, the latch 130 includes latch beams 132 configured to be received in the latch openings 118 (FIG. 1) of the receptacle connector 104.

The plug connector 102 includes an actuator 134 operably coupled to the latch 130 for actuating the latch 130 to move the latch beams 132 between latched positions and released positions, such as to release the plug connector 102 from the receptacle connector 104. The actuator 134 may be coupled to the housing 120 and/or the cover 126. In the illustrated embodiment, the actuator 134 includes a push button 136 for actuating the latch 130 and a pull tab 138 for actuating the latch 130. However, in other various embodiments, the actuator 134 may be provided without the push button 136 and/or without the pull tab 138 and may include other types of actuating features.

The push button 136 causes actuation of the latch 130 by pushing the latch 130 inward or downward to cause the latch beams 132 to move to released positions. For example, an inner surface of the push button 136 engages the latch 130 to push the latch 130 inward. The latch beams 132 are moved inward or downward when the push button 136 is pushed inward. The latch 130 is pivoted or rotated to move the latch beams 132.

The pull tab 138 causes actuation of the latch 130 by pulling on the latch 130 to cause the latch beams 132 to pivot and move inward or downward to the released positions. Further pulling on the pull tab 138, after the latch 130 is in the released position, causes the plug connector 102 to be pulled rearward to remove the plug connector 102 from the receptacle connector 104. In an exemplary embodiment, the latch 130 is rotated from the latched position to the released position when the pull tab 138 is pulled in the rearward pulling direction without loading the latch 130 against the receptacle connector 104. For example, the rearward pulling action of the pull tab 138 is initially transferred into rotating of the latch 130 before being transferred into rearward pulling of the latch 130, and thus the housing 120, to remove the plug connector 102 from the receptacle connector 104. Such releasing of the latch 130 eliminates the risk of binding of the latch 130 against the receptacle connector 104, thus reducing the releasing force of the latch 130.

Figure 3:
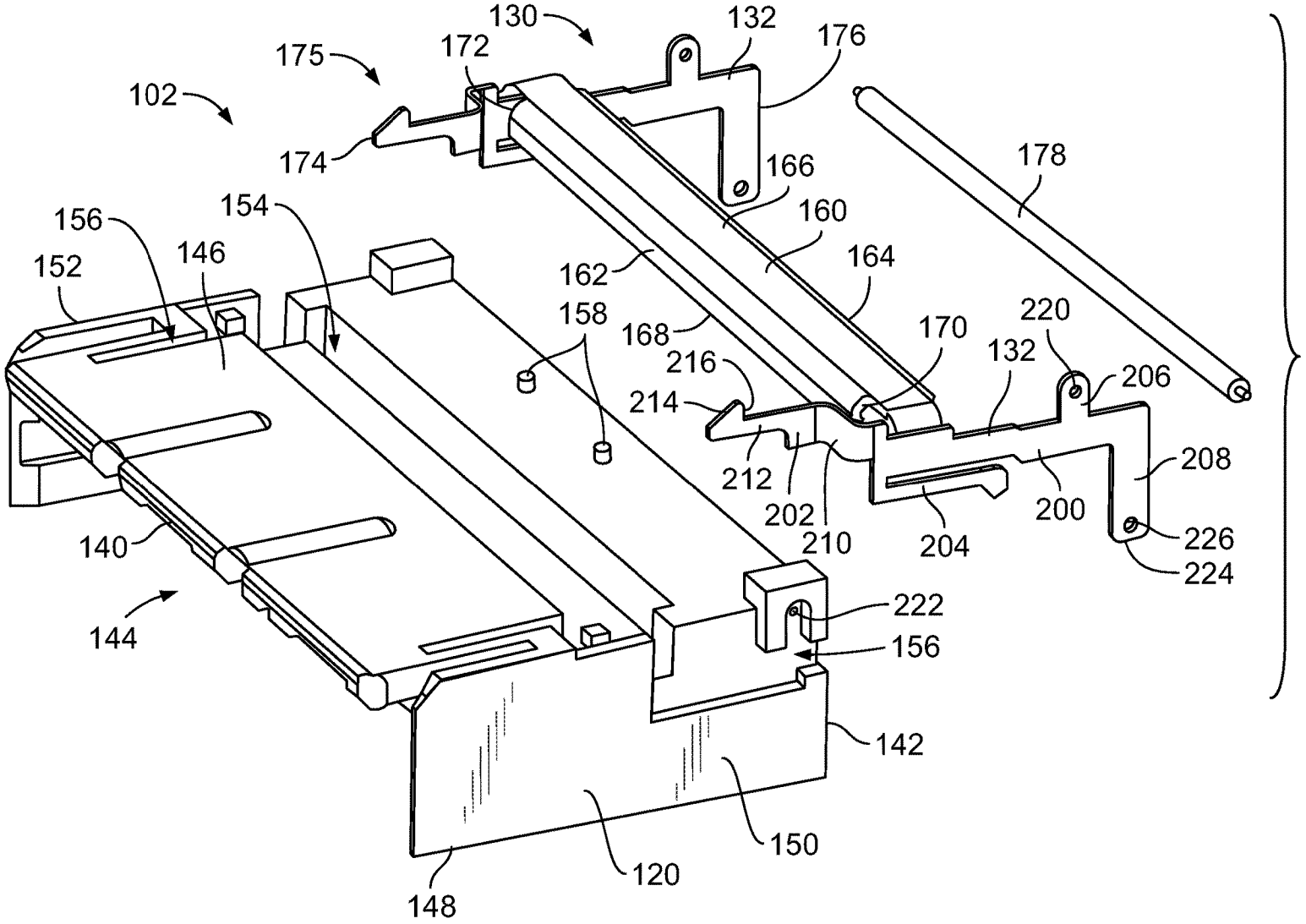
FIG. 3 is an exploded view of the plug connector in accordance with an exemplary embodiment.

FIG. 3 is an exploded view of the plug connector 102 in accordance with an exemplary embodiment. The housing 120 of the plug connector 102 includes a front 140 and a rear 142. The plug contacts 122 (shown in FIG. 2) may be located proximate to the front 140 for mating with the receptacle connector 104 (shown in FIG. 1). In an exemplary embodiment, the housing 120 has a mating end 144 at the front 140 for mating with the mating connector defined by the receptacle connector 104.

The housing 120 includes a first end 146 and a second end 148 opposite the first end 146. The first and second ends 146, 148 extend between the front 140 and the rear 142. In various orientations, the first end 146 may be a top end and the second end 148 may be a bottom end; however, other orientations are possible in alternative embodiments. The latch 130 may be provided at the first end 146.

The housing 120 includes a first side 150 and a second side 152 opposite the first side 150. The first and second sides 150, 152 extend between the front 140 and the rear 142. The first and second sides 150, 152 extend between the first end 146 and the second end 148. In various embodiments, the housing 120 may be generally rectangular shaped; however, other shapes are possible in alternative embodiments.

In an exemplary embodiment, the housing 120 has a latch pocket 154 at the first end 146. The latch pocket 154 may be located proximate to the rear 142. The latch 130 is received in the latch pocket 154. The latch pocket 154 includes latch channels 156 that receive corresponding latch beams 132 when the latch 130 is in the latch pocket 154. Optionally, at least a portion of the cover 126 (shown in FIG. 2) is received in the latch pocket 154 to secure the latch 130 in the latch pocket 154. In an exemplary embodiment, the housing 120 includes securing features 158 for securing the cover 126 to the housing 120. For example, the securing features 158 may be heat stakes, interference posts, crush ribs, fasteners, and the like.

The latch 130 includes a main body 160 extending between the latch beams 132. In an exemplary embodiment, the latch 130 is a stamped and formed component with the main body 160 and the latch beams 132 being integral with each other and being stamped and formed from a common sheet of metal. Alternatively, the main body 160 may be separately formed from the latch beams 132 and coupled thereto, such as being welded or fastened to the latch beams 132. The main body 160 includes a front 162 and a rear 164. The main body 160 includes a first end 166 and a second end 168 opposite the first end 166. The first and second ends 166, 168 extend between the front 162 and the rear 164. In various orientations, the first end 166 may be a top end and the second end 168 may be a bottom end; however, other orientations are possible in alternative embodiments. The main body 160 includes a first side 170 and a second side 172 opposite the first side 170. The first and second sides 170, 172 extend between the front 162 and the rear 164.

The latch beams 132 are provided at the first and second sides 170, 172. The latch beams 132 extend forward of the main body 160 and rearward of the main body 160. In various embodiments, the main body 160 may be approximately centered along the latch beams 132. In the illustrated embodiment, two latch beams 132 are provided; however, greater or fewer latch beams 132 may be provided in alternative embodiments.

Each latch beam 132 extends between a front 174 and a rear 176. The front 174 defines a latching end 175 of the latch beam 132. In an exemplary embodiment, a cross beam 178 extends between the latch beams 132 at the rear 176. The pull tab 138 (FIG. 1) is configured to be coupled to the cross beam 178. The cross beam 178 may be separate and discrete from the latches 130 and coupled to the latch beams 132 at the rear 176.

In an exemplary embodiment, each latch beam 132 includes a latch arm 200, a latch hook 202, a return spring 204, an anchor tab 206 and a pull arm 208. In various embodiments, the latch arm 200 defines a main section of the latch beam 132 and other parts of the latch beam 132 extend from or off of the latch arm 200. For example, in the illustrated embodiment, the latch hook 202 extends from the latch arm 200, the return spring 194 extends from the latch arm 200, the anchor tab 206 extends from the latch arm 200 and the pull arm 208 extends from the latch arm 200. Other arrangements are possible in alternative embodiments. The latch beam 132 may have other parts in alternative embodiments. Optionally, the latch arm 200 may be planar and define a latch plane for the latch 130. The latch plane may be a vertical latch plane. The latch hook 202, and/or the return spring 204, and/or the anchor tab 206, and/or the pull arm 208 may be contained within the latch plane. In the illustrated embodiment, the return spring 204, the anchor tab 206, and the pull arm 208 are all contained within the latch plane, while the latch hook 202 is bent inward out of the latch plane.

The latch hook 202 is provided at the latching end 175. The latch hook 202 is configured to be received in the corresponding latch opening 118 of the receptacle connector 104 (both shown in FIG. 1). The latch hook 202 is provided at a front end of the latch arm 200 and extends forward of the latch arm 200. In an exemplary embodiment, the latch hook 202 includes a transition wall 210 extending from the latch arm 200 and a front wall 212 extending from the transition wall 210. In the illustrated embodiment, the transition wall 210 is perpendicular to the latch arm 200 and the front wall 212 is perpendicular to the transition wall 210; however, the transition wall 210 and the front wall 212 may be at other angles in alternative embodiments. The latch hook 202 includes a latching feature 214 having a rear facing catch surface 216. The latching feature 214 extends from the front wall 212. The catch surface 216 is received in the latch opening 118 and configured to engage the receptacle connector 104 to secure the plug connector 102 in the receptacle connector 104. The latching feature 214 may be ramped at the front for loading into the receptacle connector 104. The transition wall 210 locates the front wall 212, and thus the latching feature 214, relative to the housing 120 for latching connection with the receptacle connector 104.

The return spring 204 extends from the latch arm 200. In the illustrated embodiment, the return spring 204 is provided proximate to the latch hook 202. For example, the return spring 204 extends from the front end of the latch arm 200. Optionally, the return spring 204 extends from the bottom of the latch arm 200 and is located below the latch arm 200. The return spring 204 may extend rearward and is separated from the latch arm 200 by a gap. The return spring 204 is configured to engage the housing 120. The return spring 204 is used to hold the latch 130 in the latched position. The return spring 204 operates to force or return the latch 130 from the released position to the latched position.

The anchor tab 206 extends from the latch arm 200. In the illustrated embodiment, the anchor tab 206 is provided proximate to a rear end of the latch arm 200; however, the anchor tab 206 may be at other locations in alternative embodiments. The anchor tab 206 includes an anchor point 220 used to secure the latch 130 to the housing 120. In the illustrated embodiment, the anchor point 220 is an opening in the anchor tab 206 configured to receive an axle 222. The axle 222 may be part of the housing 120. Alternatively, the axle 222 may be a separate component coupled to the housing 120. The latch 130 is pivotably coupled to the housing 120 at the anchor point 220. In the illustrated embodiment, the anchor tab 206 extends from the top of the latch arm 200 to locate the anchor point 220 and a vertical location above the latch arm 200. Optionally, the anchor point 220 may be generally aligned with the latch hook 202, such as with the latching feature 214 of the latch hook 202. For example, the anchor point 220 may be coplanar with the catch surface 216 of the latch hook 202 in a plane parallel to the rearward pulling direction of the pull tab 138 (for example, a horizontal plane).

The pull arm 208 extends from the latch arm 200. In the illustrated embodiment, the pull arm 208 is provided at the rear end of the latch arm 200. The pull arm 208 may be provided at other locations in alternative embodiments. In an exemplary embodiment, the pull arm 208 extends from the bottom of the latch arm 200, such as perpendicularly from the pull arm 208; however, the pull arm 208 may extend at other angles in alternative embodiments. The pull arm 208 extends to a distal end 224. The pull arm 208 has an attachment point 226 at the distal end 224 for attaching the cross beam 178 to the latch beam 132. The attachment point 226 may be an opening in the pull arm 208 configured to receive a post or other feature of the cross beam 178. Alternatively, a fastener, such as a screw, may be received in the opening to secure the cross beam 178 to the pull arm 208. The pull arm 208 extends from the latch arm 200 such that the attachment point 226 is offset from the anchor point 220. For example, in the illustrated embodiment, the attachment point 226 is vertically offset and horizontally offset from the anchor point 220 to create a moment or turning effect on the latch 130 when the pull tab 138 is pulled in the rearward pulling direction.

Figure 4:
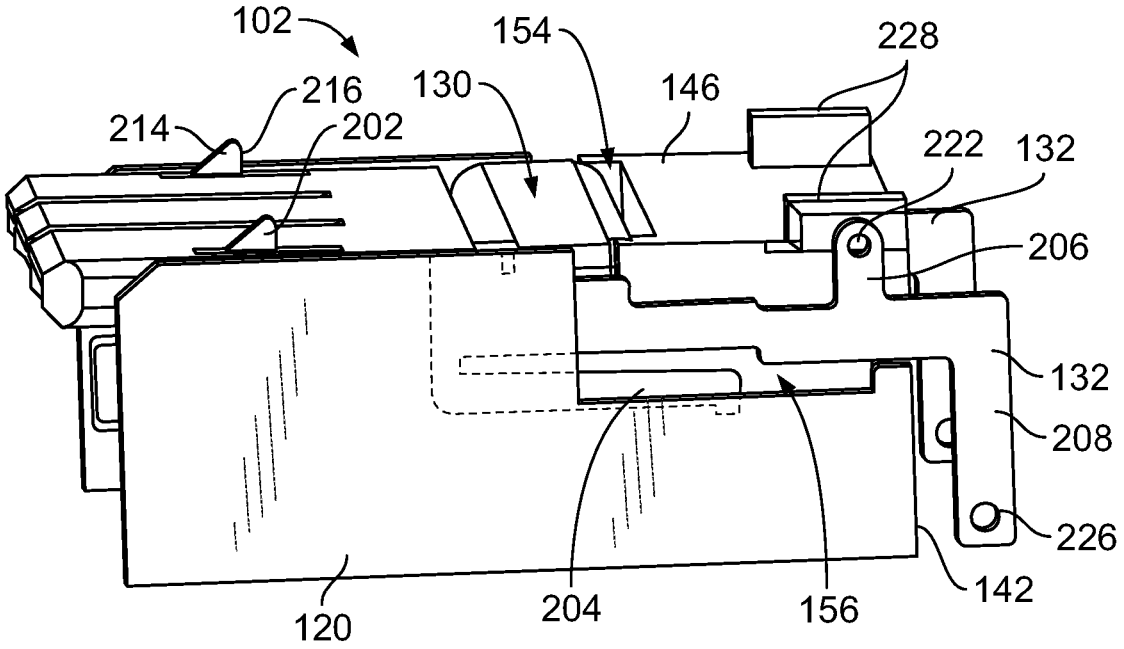
FIG. 4 is a side perspective view of the plug connector illustrating a latch in a latched position in accordance with an exemplary embodiment.
Figure 5:
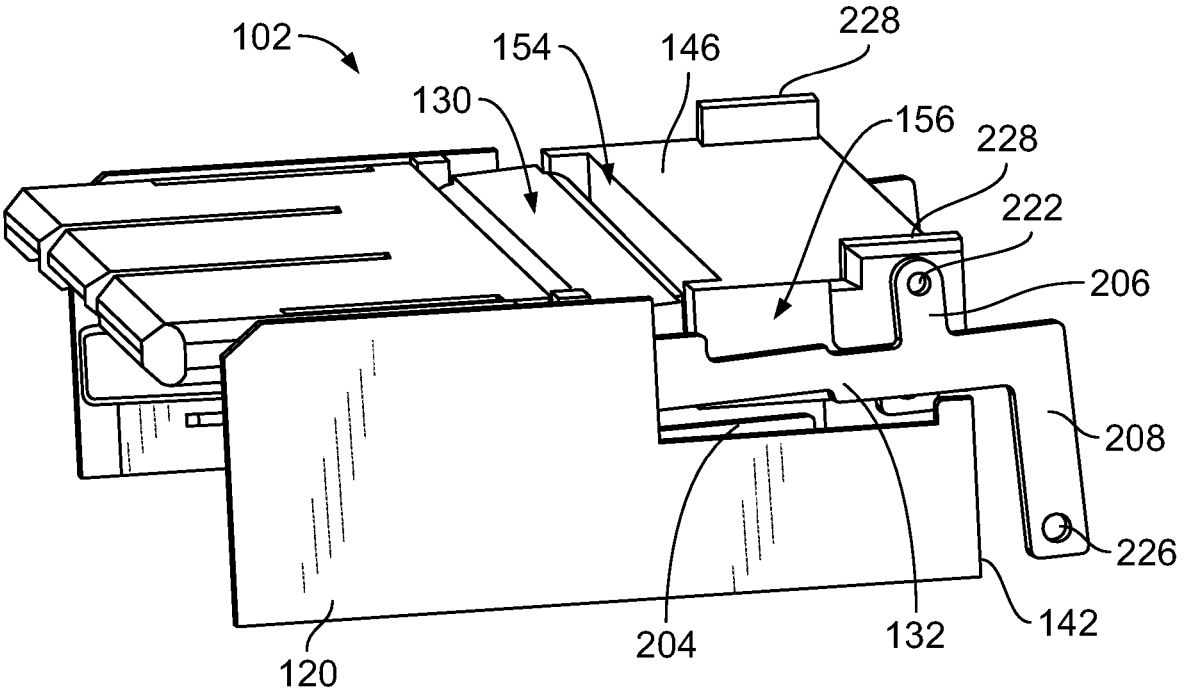
FIG. 5 is a side perspective view of the plug connector illustrating the latch in a released position in accordance with an exemplary embodiment.

FIG. 4 is a side perspective view of the plug connector 102 illustrating the latch 130 in the latched position. FIG. 5 is a side perspective view of the plug connector 102 illustrating the latch 130 in the released position. The latch 130 is received in the latch pocket 154 with the latch beam 132 in the latch channel 156. In an exemplary embodiment, a portion of the latch 130 extends rearward of the housing 120. For example, the pull arm 208 extends rearward of the rear 142 of the housing 120. The return spring 204 engages the housing 120 in the latch channel 156.

The anchor tab 206 is secured to the housing 120 at the axle 222. The latch 130 is pivotably coupled to the axle 222. Optionally, the housing 120 may include a step 228 at the first end 146. The step 228 is an elevated portion allowing positioning of the axle 222 at an elevated position, such as to raise or align the attachment point 226 generally in line with the latch hook 202. For example, by stepping up a portion of the housing 120 at the step 228, the anchor tab 206 may extend to an elevation at or above the first end 146, such as to a vertical height generally co-planer with the catch surface 216 of the latch hook 202. As such, the pivot axis of the latch 130 is generally aligned with the latching surface of the latch hook 202, which reduces the moment or forces needed to rotate and release the latch 130 to the released position.

In the latched position (FIG. 4), the latching features 214 of the latch hooks 202 extend above the first end 146 of the housing 120 for interfacing with the receptacle connector 104. The return spring 204 presses against the housing 120 to hold the latch 130 in the released position holding the latch hooks 202 in the elevated, latched positions. The spring force of the return spring 204 may be overcome by pushing on the push button 136 (FIG. 1) or pulling on the pull tab 138 (FIG. 1) to rotate the latch 130 to the released position (FIG. 5). In the released position, the latch hooks 202 are rotated downward into the latch channels 156, such as below the first end 146. The latch hooks 202 may clear the first end 146 to allow the plug connector 102 to be removed from the receptacle connector 104.

Figure 6:
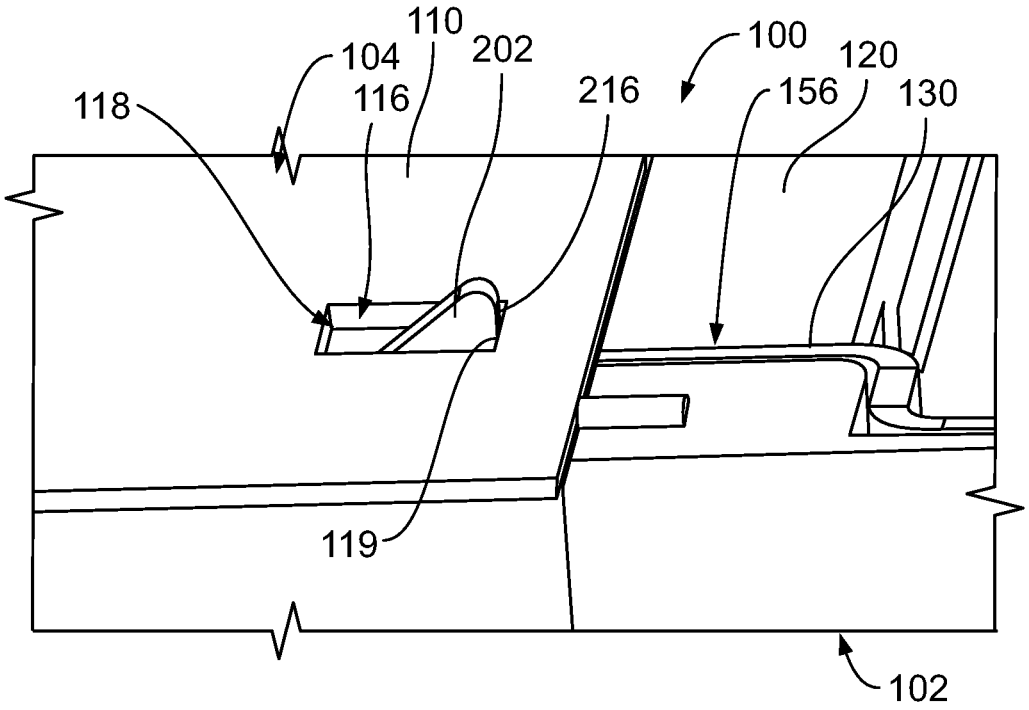
FIG. 6 is a top perspective view of a portion of the connector system showing the plug connector mated with a receptacle connector illustrating the latch in the latched position in accordance with an exemplary embodiment.
Figure 7:
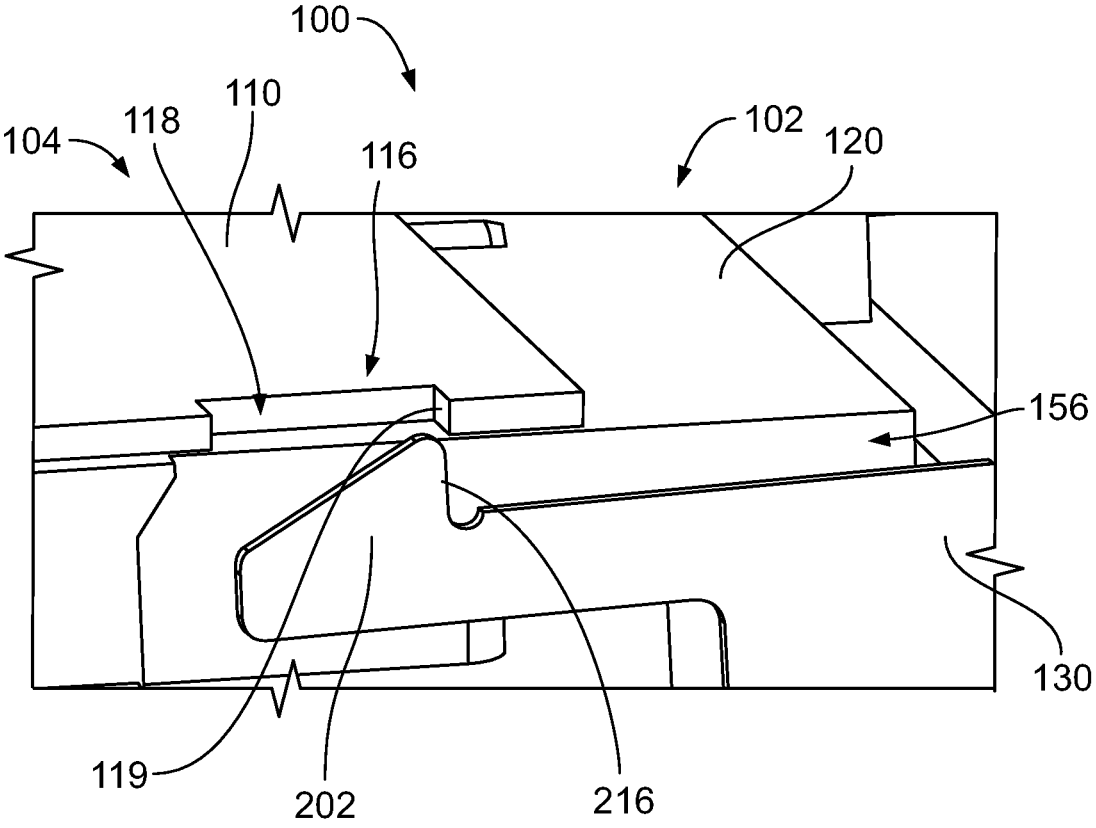
FIG. 7 is a cross-sectional view of a portion of the connector system showing the plug connector mated with the receptacle connector illustrating the latch in the released position in accordance with an exemplary embodiment.

FIG. 6 is a top perspective view of a portion of the connector system 100 showing the plug connector 102 mated with the receptacle connector 104 illustrating the latch 130 in the latched position. FIG. 7 is a cross-sectional view of a portion of the connector system 100 showing the plug connector 102 mated with the receptacle connector 104 illustrating the latch 130 in the released position.

In the latched position (FIG. 6), the latch hook 202 is received in the latch opening 118. The catch surface 216 engages the latching feature 116 of the receptacle connector 104. For example, the catch surface 216 engages a wall 119 defining the latch opening 118. The latch 130 prevents pullout or removal of the plug connector 102 from the receptacle connector 104 in the latched position.

In the released position (FIG. 7), the latch hook 202 is rotated forward and downward relative to the housing 110 of the receptacle connector 104. For example, the catch surface 216 is moved away from the wall 119 (for example, rotation of the latch 130 causes the catch surface 216 to move in a clearance direction, initially forward of the wall 119 and then rotating below the housing 110). By initially moving the catch surface 216 away from the wall 119, the latch hook 202 does not bind against the housing 120 during unlatching and removal of the plug connector 102 from the mating connector 104. In an exemplary embodiment, the latch hook 202 is rotated from the latched position to the released position when the pull tab 138 is pulled in the rearward pulling direction without loading the latch 130 against the mating connector 104 because the latch hook 202 initially rotates away from the wall 119 of the latch opening 118 when the pull tab 138 is initially pulled rearward. The rearward pulling motion of the pull tab 138 is not transferred from the latch 130 to the housing 110 until the latch 130 is rotated to the released position. Once the latch 130 bottoms out in the latch channel 156 in the released position, further rearward pulling on the pull tab 138 no longer corresponds to rotation of the latch 130, but rather is converted to rearward pulling of the housing 120 by the latch 130.

Figure 8:
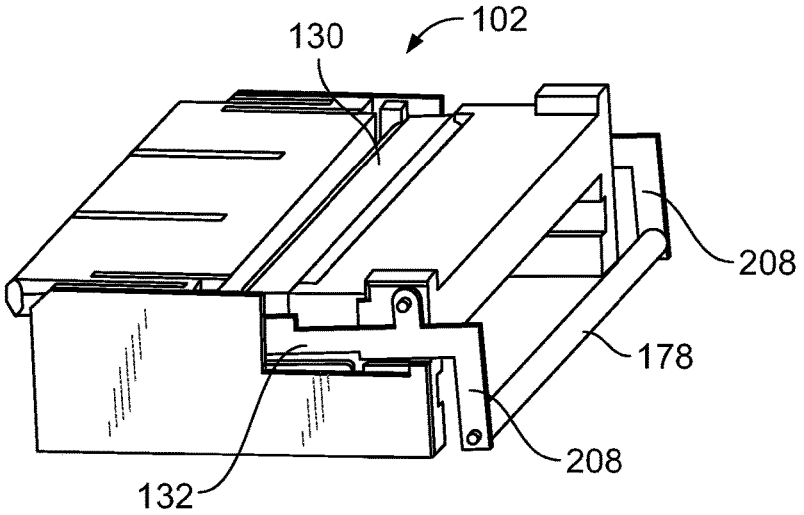
FIG. 8 is a rear perspective view of the plug connector showing the latch in the released position in accordance with an exemplary embodiment.

FIG. 8 is a rear perspective view of the plug connector 102 showing the latch 130 in the released position. The cross beam 178 is illustrated extending between the pull arms 208. The cross beam 178 supports the pull arms 208 and prevents the pull arms 208 from rotating inward toward each other. The cross beam 178 maintains the spacing between the latch beams 132. The cross beam 178 provides a member for attaching the pull tab 138 (shown in FIGS. 9 and 10).

Figure 9:
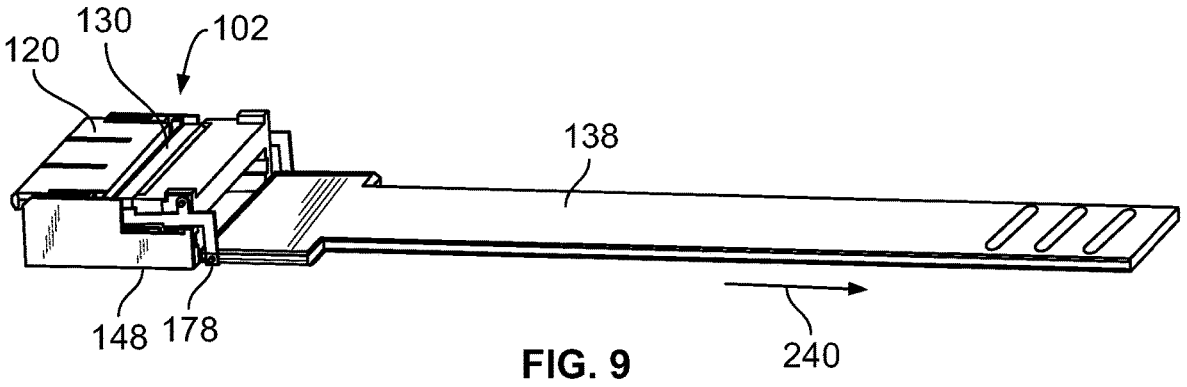
FIG. 9 is a perspective view of the plug connector in accordance with an exemplary embodiment.

FIG. 9 is a perspective view of the plug connector 102 in accordance with an exemplary embodiment. FIG. 9 illustrates the pull tab 138 coupled to the cross beam 178. The pull tab 138 is generally aligned with the second end 148 of the housing 120, such as at or below the bottom of the housing 120. Such positioning of the pull tab 138 allows the cables to exit the housing 120 above the pull tab 138. The pull tab 138 is configured to be pulled in a rearward pulling direction 240 to actuate the latch 130. Pulling on the pull tab 138 initially rotates the latch 130 to the released position. Further pulling on the pull tab 138 in the rearward pulling direction 240, after the latch 130 is in the released position, causes the latch 130 to transfer the rearward pulling motion to the housing 120, such as to remove the plug connector 102 from the receptacle connector 104 (shown in FIG. 1).

Figure 10:
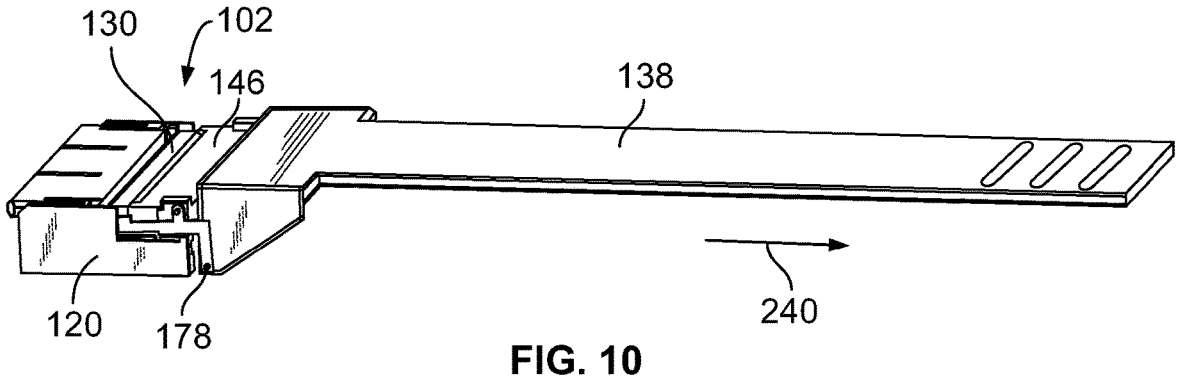
FIG. 10 is a perspective view of the plug connector in accordance with an exemplary embodiment.

FIG. 10 is a perspective view of the plug connector 102 in accordance with an exemplary embodiment. FIG. 10 illustrates the pull tab 138 coupled to the cross beam 178. The pull tab 138 is generally aligned with the first end 146 of the housing 120, such as at or above the top of the housing 120. Such positioning of the pull tab 138 allows the cables to exit the housing 120 below the pull tab 138. The pull tab 138 is configured to be pulled in the rearward pulling direction 240 to actuate the latch 130. Pulling on the pull tab 138 initially rotates the latch 130 to the released position. Further pulling on the pull tab 138 in the rearward pulling direction 240, after the latch 130 is in the released position, causes the latch 130 to transfer the rearward pulling motion to the housing 120, such as to remove the plug connector 102 from the receptacle connector 104 (shown in FIG. 1).

Figure 11:
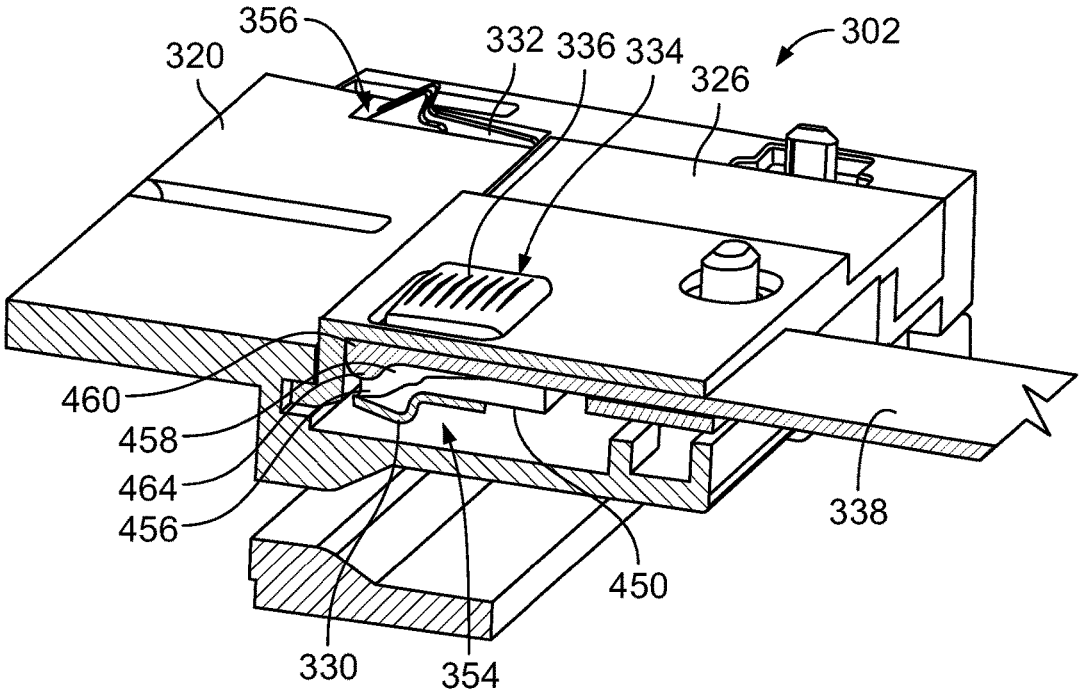
FIG. 11 is a cross sectional view of a plug connector in accordance with an exemplary embodiment.
Figure 12:
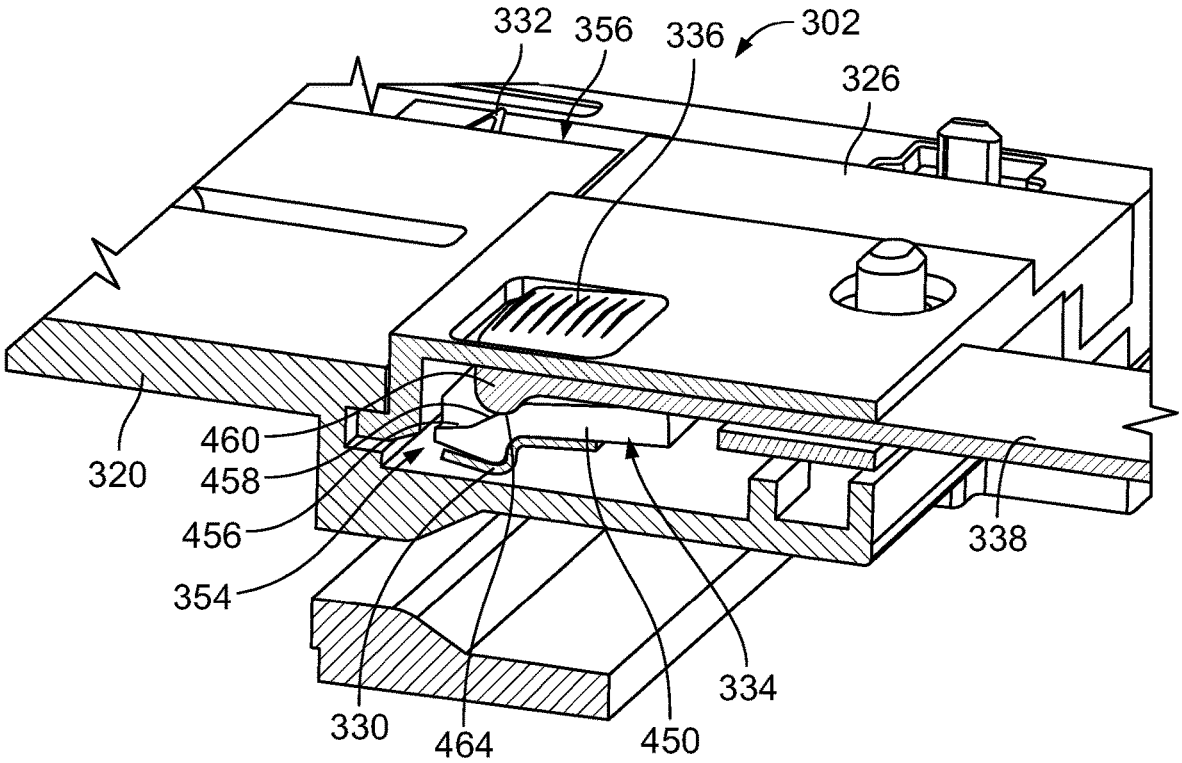
FIG. 12 illustrates the plug connector shown in FIG. 11 in accordance with an exemplary embodiment showing a latch in a released position in accordance with an exemplary embodiment.

FIG. 11 is a cross sectional view of a plug connector 302 in accordance with an exemplary embodiment showing a latch 330 of the plug connector in a latched position. FIG. 12 illustrates the plug connector 302 in accordance with an exemplary embodiment showing the latch 330 in a released position. The plug connector is configured to be mated with the receptacle connector 104 (shown in FIG. 1). The plug connector 302 is similar to the plug connector 102; however, the plug connector 302 includes a different arrangement of the actuator and the latch.

The plug connector 302 includes a housing 320 and a cover 326 coupled to the housing 320. The latch 330 is received in a latch pocket 354 in the housing 320 and secured in the housing 320 by the cover 326. For example, the cover 326 may cover a portion of the latch 330. The latch 330 latchably secures the plug connector 302 to the receptacle connector 104. In the illustrated embodiment, the latch 330 includes latch beams 332 configured to be received in the latch openings 118 (FIG. 1) of the receptacle connector 104. The latch beams 332 are received in latch channels 356 in the housing 320.

The plug connector 302 includes an actuator 334 operably coupled to the latch 330 for actuating the latch 330 to move the latch beams 332 between latched positions and released positions to release the plug connector 302 from the receptacle connector 104. In the illustrated embodiment, the actuator 334 includes a push button 336 for actuating the latch 330 and a pull tab 338 for actuating the latch 330. However, in other various embodiments, the actuator 334 may be provided without the push button 336 and/or without the pull tab 338 and may include other types of actuating features.

The push button 336 causes actuation of the latch 330 by pushing the latch 330 inward or downward to cause the latch beams 332 to move to released positions. For example, an inner surface of the push button 336 engages the latch 330 to push the latch 330 inward. The latch beams 332 are moved inward or downward when the push button 336 is pushed inward. The latch 330 is pivoted or rotated to move the latch beams 332.

The pull tab 338 causes actuation of the latch 330 by pushing on the push button 336, which likewise pushes on the latch 330, to cause the latch beams 332 to pivot and move inward or downward to the released positions. The pull tab 338 is initially slidable or movable relative to the push button 336 to actuate the push button and release the latch 130 to the released position. Once the latch 130 is in the released position, further pulling on the pull tab 338, causes the plug connector 302 to be pulled rearward to remove the plug connector 302 from the receptacle connector 104. In an exemplary embodiment, the latch 330 is rotated from the latched position to the released position when the pull tab 338 is pulled in the rearward pulling direction without loading the latch 330 against the receptacle connector 104. For example, the rearward pulling action of the pull tab 338 is initially transferred into rotating of the latch 330 before being transferred into rearward pulling of the latch 330, and thus the housing 320, to remove the plug connector 302 from the receptacle connector 104. Such releasing of the latch 330 eliminates the risk of binding of the latch 330 against the receptacle connector 104, thus reducing the releasing force of the latch 330.

Figure 13:
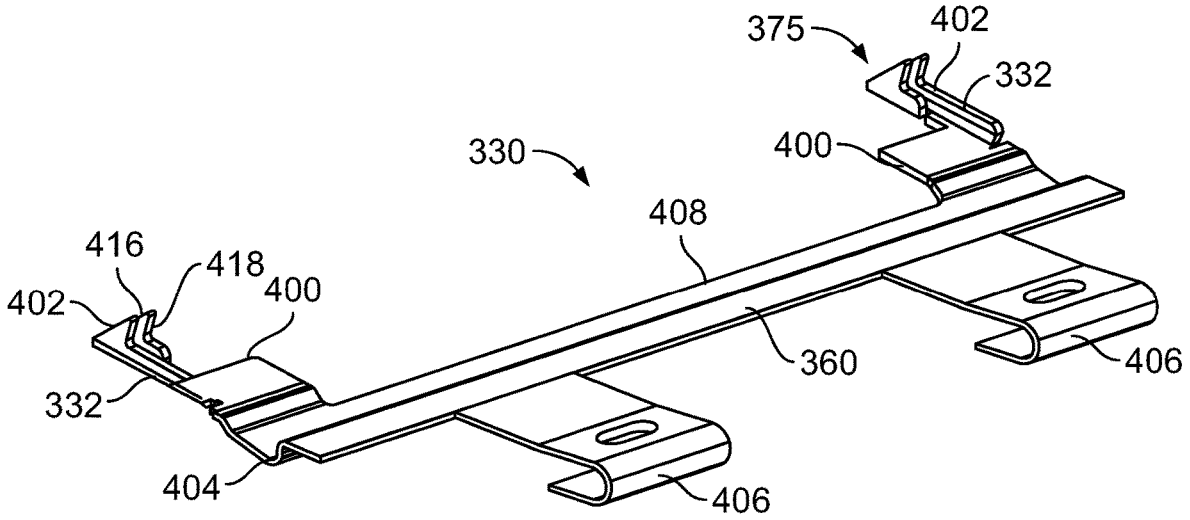
FIG. 13 is a perspective view of the latch shown in FIG. 12 in accordance with an exemplary embodiment.

FIG. 13 is a perspective view of the latch 330 in accordance with an exemplary embodiment. The latch 330 includes a main body 360 extending between the latch beams 332. In an exemplary embodiment, the latch 330 is a stamped and formed component with the main body 360 and the latch beams 332 being integral with each other and being stamped and formed from a common sheet of metal. Alternatively, the main body 360 may be separately formed from the latch beams 332 and coupled thereto, such as being welded or fastened to the latch beams 332.

The latch beams 332 are provided at opposite sides of the main body 360 and extend forward of the main body 360. Each latch beam 332 extends to a latching end 375. In an exemplary embodiment, each latch beam 332 includes a latch arm 400 and a latch hook 402 extending from the latch arm 400. The latch 330 includes return spring 404 for returning the latch 330 to the latched position. The latch 330 includes one or more anchor tabs 406 for securing the latch 330 to the housing 320. The latch 330 includes an actuator arm 408 actuated by the actuator 334 (FIG. 11).

The latch hook 402 is provided at the latching end 375. The latch hook 402 is configured to be received in the corresponding latch opening 118 of the receptacle connector 104 (both shown in FIG. 1). The latch hook 402 includes a latching feature 416 having a rear facing catch surface 418. The catch surface 418 is received in the latch opening 118 and configured to engage the receptacle connector 104 to secure the plug connector 302 in the receptacle connector 104. The latching feature 416 may be ramped at the front for loading into the receptacle connector 104.

In the illustrated embodiment, the return spring 404 is part of the main body 360. The return spring 404 extends the length of the main body 360. The return spring 404 is formed by one or more bends in the main body 360, which are configured to be bent when the latch 330 is deflected creating an internal spring force within the latch 330 causing the latch 330 to return to the latched position.

The anchor tabs 406 extend rearward from the main body 360. In the illustrated embodiment, the anchor tabs 406 are configured to be secured to the securing features 358. The anchor tabs 406 may be secured to the housing 320 and/or the cover 326.

The actuator arm 408 is part of the main body 360. The actuator arm 408 includes one or more surfaces configured to be engaged by the actuator 334 to deflect the latch 330 to the released position.

Figure 14:
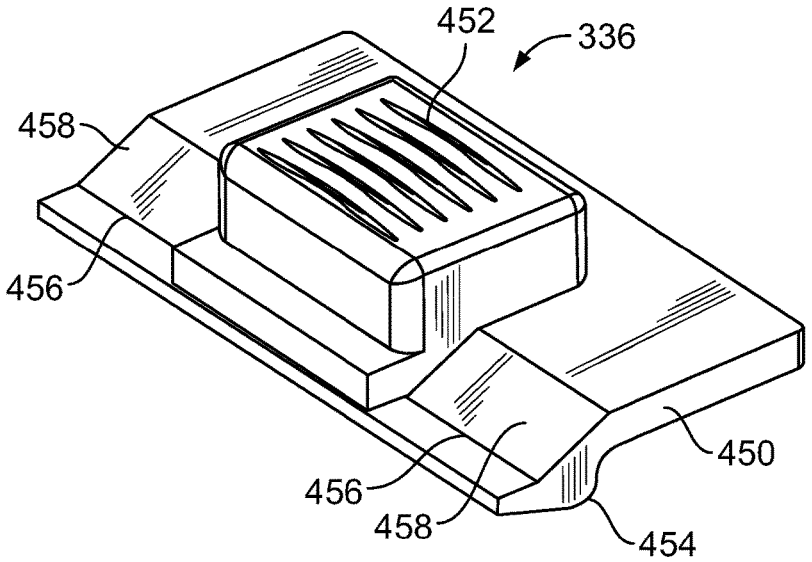
FIG. 14 is a top perspective view of a push button of the plug connector shown in FIG. 11 in accordance with an exemplary embodiment.

FIG. 14 is a top perspective view of the push button 336 in accordance with an exemplary embodiment. The push button 336 includes a base 450 and a push button element 452 extending from the base 450. The base 450 includes a push bar 454 at a bottom of the base 450 configured to engage the latch 330 to deflect the latch 330 when the push button 336 is activated. The base 450 includes pads 456 on opposite sides of the push button element 452. The pads 456 are configured to be engaged by the pull tab 338. The push button element 452 and the pads 456 are aligned above the push bar 454 and are configured to push downward on the push bar 454 when activated by the user. The push bar 454 is configured to engage the actuator arm 408 (shown in FIG. 13) to actuate the latch 330. In an exemplary embodiment, the pads 456 include drive surfaces 458 configured to be engaged by the pull tab 338. Optionally, the drive surfaces 458 may be angled. For example, the drive surfaces 458 may be ramp surfaces.

Figure 15:
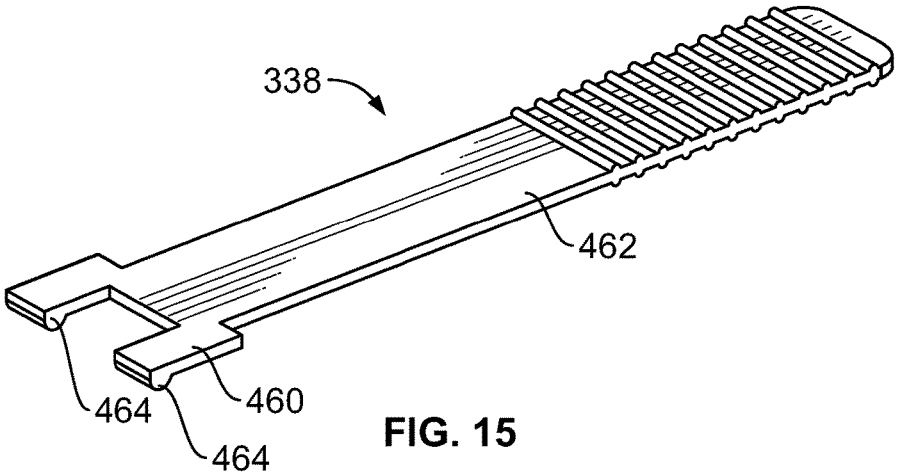
FIG. 15 is a top perspective view of a pull tab of the plug connector shown in FIG. 11 in accordance with an exemplary embodiment.

FIG. 15 is a top perspective view of the pull tab 338 in accordance with an exemplary embodiment. The pull tab 338 includes a head 460 and a grip 462 opposite the head 460. The head 460 includes embossments 464 at the bottom of the head 460. The embossments 464 are configured to engage the push button 336 when the pull tab 338 is actuated by the user.

Returning to FIGS. 11 and 12, the push button 336 and the pull tab 338 are operably coupled to the latch 330 between the housing 320 and the cover 326. The pull tab 338 is separate and discrete from the push button 336. The pull tab 338 is slidably coupled to the push button 336. The head 460 of the pull tab 338 is coupled to the base 450 of the push button 336. The embossments 464 engage the pads 456 and ride along the drive surfaces 458 as the pull tab 338 is pulled in the rearward polling direction. As the embossments 464 ride along the drive surfaces 458, the pull tab 338 forces the base 450 of the push button 336 downward, thus forcing the latch 330 to the released position without transferring the rearward polling motion to the housing 320. The rearward polling of the pull tab 338 is transferred to rotational movement of the latch 330 without loading the latch 330 against the mating connector 104. When the embossments 464 reaches the end of the drive surfaces 458, the actuator 334 and the latch 330 bottom out within the housing 320. There is no longer clearance for further rearward movement of the pull tab 338 relative to the push button 336. Further pulling of the pull tab 338 and the rearward polling direction is transferred from the actuator 334 to the latch 330, and thus to the housing 320, causing removal of the plug connector 302 from the receptacle connector 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A plug connector comprising:

a housing having a front and a rear, the housing having a first end and a second end opposite the first end extending between the front and the rear, the housing having a first side and a second side opposite the first side extending between the front and the rear, the housing having a mating end at the front for mating with a mating connector, the housing having a latch pocket at the first end;

plug contacts held by the housing, the plug contacts provided proximate to the mating end for mating with the mating connector;

a latch received in the latch pocket, the latch having a main body and a latch beam extending from the main body, the latch beam including a latch hook configured to be received in a latch opening of the mating connector to secure the plug connector to the mating connector; and an actuator operably coupled to the latch to move the latch to a released position, the actuator including a push button and a pull tab, the push button accessible at the first end and engaging the main body of the latch for actuation of the latch, the pull tab extending from the rear of the housing and being pulled in a rearward pulling direction to actuate the latch, the pull tab being separate from the push button and being movable in the rearward pulling direction relative to the push button;

wherein the latch hook is rotated from a latched position to the released position when the push button is actuated by pressing inward toward the main body, the latch hook being rotated from the latched position to the released position when the pull tab is pulled in the rearward pulling direction without loading the latch against the mating connector.

2. The plug connector of claim 1, wherein the latch hook rotates away from the latch opening when the pull tab is initially pulled rearward.

3. The plug connector of claim 1, wherein the latch hook includes a rear facing catch surface, the catch surface being forward rotated away from the latch opening when the pull tab is initially pulled rearward.

4. The plug connector of claim 1, wherein rearward pulling motion of the pull tab is not transferred from the latch to the housing until the latch is rotated to the released position.

5. The plug connector of claim 1, wherein the latch beam includes an anchor point, the latch being pivoted about the anchor point, the anchor point being generally aligned with the latch hook.

6. The plug connector of claim 5, wherein the anchor point is coplanar with the latch hook in a plane parallel to the rearward pulling direction.

7. The plug connector of claim 1, wherein the latch beam includes a return spring engaging the housing, the return spring operating to return the latch from the released position to the latched position.

8. The plug connector of claim 7, wherein the return spring acts on the latch beam at a location between the main body and the latch hook.

9. The plug connector of claim 1, wherein the pull tab is slidably coupled to the push button, the pull tab including an embossment engaging the push button to depress the push button as the pull tab is moved in the rearward pulling direction to actuate the latch.

10. The plug connector of claim 9, wherein the push button includes an angled drive surface, the embossment riding on the drive surface to actuate the push button as the pull tab is moved in the rearward pulling direction to actuate the latch.

11. The plug connector of claim 1, wherein the latch beam is a first latch beam, the latch further comprising a second latch beam extending from the main body, the second latch beam including a second latch hook configured to be received in a corresponding latch opening of the mating connector to secure the plug connector to the mating connector.

12. A plug connector comprising:

a housing having a front and a rear, the housing having a first end and a second end opposite the first end extending between the front and the rear, the housing having a first side and a second side opposite the first side extending between the front and the rear, the housing having a mating end at the front for mating with a mating connector, the housing having a latch pocket at the first end;

plug contacts held by the housing, the plug contacts provided proximate to the mating end for mating with the mating connector;

a latch received in the latch pocket, the latch being movable within the housing between a latched position and a released position, the latch having a main body and a latch beam extending from the main body, the latch beam including a latch arm, the latch beam including a latch hook extending from the latch arm, the latch hook configured to be received in a latch opening of the mating connector to secure the plug connector to the mating connector, the latch beam including an anchor point secured to the housing, the latch beam being pivotably coupled to the housing at the anchor point, the latch beam including a pull arm extending from the latch arm, the pull arm being offset from the anchor point; and an actuator operably coupled to the latch to move the latch from the latched position to the released position, the actuator including a push button and a pull tab, the push button engaging the main body of the latch for actuation of the latch, the pull tab coupled to the latch arm, the pull tab extending from the rear of the housing and being pulled in a rearward pulling direction to actuate the latch.

13. The plug connector of claim 12, wherein the pull tab is separate from the push button and movable in the rearward pulling direction relative to the push button.

14. The plug connector of claim 12, wherein the latch hook is rotated from a latched position to the released position when the push button is actuated by pressing inward toward the main body, and wherein the latch hook is rotated from the latched position to the released position when the pull tab is pulled in the rearward pulling direction without loading the latch against the mating connector.

15. The plug connector of claim 12, wherein the latch hook includes a rear facing catch surface, the catch surface being forward rotated away from the latch opening when the pull tab is initially pulled rearward.

16. The plug connector of claim 12, wherein rearward pulling motion of the pull tab is not transferred from the latch to the housing until the latch is rotated to the released position.

17. The plug connector of claim 12, wherein the anchor point is coplanar with the latch hook in a plane parallel to the rearward pulling direction.

18. The plug connector of claim 12, wherein the latch beam includes a return spring engaging the housing, the return spring operating to return the latch from the released position to the latched position.

19. A plug connector comprising:

a housing having a front and a rear, the housing having a first end and a second end opposite the first end extending between the front and the rear, the housing having a first side and a second side opposite the first side extending between the front and the rear, the housing having a mating end at the front for mating with a mating connector, the housing having a latch pocket at the first end;

plug contacts held by the housing, the plug contacts provided proximate to the mating end for mating with the mating connector;

a latch received in the latch pocket, the latch being movable within the housing between a latched position and a released position, the latch having a main body and a latch beam extending from the main body, the latch beam including a latch arm, the latch beam including a latch hook extending from the latch arm, the latch hook configured to be received in a latch opening of the mating connector to secure the plug connector to the mating connector, the latch beam including an anchor point secured to the housing, the latch beam being pivotably coupled to the housing at the anchor point, the latch beam including a pull arm extending from the latch arm, the pull arm being offset from the anchor point, the latch beam including a return spring extending from the latch arm and engaging the housing, the return spring operating to return the latch from the released position to the latched position; and an actuator operably coupled to the latch to move the latch from the latched position to the released position, the actuator including a push button and a pull tab, the push button engaging the main body of the latch for actuation of the latch, the pull tab coupled to the latch arm, the pull tab extending from the rear of the housing and being pulled in a rearward pulling direction to actuate the latch.

20. The plug connector of claim 19, wherein the pull tab is separate from the push button and movable in the rearward pulling direction relative to the push button, the latch hook being rotated from the latched position to the released position when the push button is actuated by pressing inward toward the main body, the latch hook being rotated from the latched position to the released position when the pull tab is pulled in the rearward pulling direction without loading the latch against the mating connector.

* * * * *